US007692543B2

(12) United States Patent
Copeland et al.

(10) Patent No.: US 7,692,543 B2
(45) Date of Patent: Apr. 6, 2010

(54) ANTENNA FOR A COMBINATION EAS/RFID TAG WITH A DETACHER

(75) Inventors: Richard L. Copeland, Lake Worth, FL (US); Gary Mark Shafer, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 247 days.

(21) Appl. No.: 11/666,790

(22) PCT Filed: Nov. 2, 2005

(86) PCT No.: PCT/US2005/039584

§ 371 (c)(1),
(2), (4) Date: Apr. 30, 2007

(87) PCT Pub. No.: WO2006/050407

PCT Pub. Date: May 11, 2006

(65) Prior Publication Data

US 2007/0296594 A1 Dec. 27, 2007

Related U.S. Application Data

(60) Provisional application No. 60/624,402, filed on Nov. 2, 2004, provisional application No. 60/659,288, filed on Mar. 7, 2005, provisional application No. 60/659,380, filed on Mar. 7, 2005.

(51) Int. Cl.
*G08B 13/14* (2006.01)

(52) U.S. Cl. ..... 340/572.1; 340/572.2; 340/572.3; 340/572.7; 340/572.8; 340/572.9; 70/57.1; 24/704.1; 24/704.2

(58) Field of Classification Search ..... 340/572.1, 340/572.7, 572.8, 572.9, 572.3, 551, 568.1, 340/825.53; 70/57.1, 391, 416, 454, 453; 24/704.1, 704.2
See application file for complete search history.

(56) References Cited

U.S. PATENT DOCUMENTS 5,955,951 A * 9/1999 Wischerop et al. ..... 340/572.8
6,281,794 B1 * 8/2001 Duan et al. ..... 340/572.1

FOREIGN PATENT DOCUMENTS

JP 2002290141 * 10/2002

* cited by examiner

*Primary Examiner*—George A Bugg
*Assistant Examiner*—Sisay Yacob
(74) *Attorney, Agent, or Firm*—Alan M. Weisberg; Christopher & Weisberg, P.A.

(57) ABSTRACT

A security device detaches a combination electronic article surveillance (EAS) and radio frequency identification (RFID) tag (EAS/RFID tag), and includes a detacher (magnet) to selectively disengage a clutch release disposed in a first portion of the combination EAS/RFID tag, a near field antenna configured to electronically read information stored in a second portion of the combination EAS/RFID tag. The antenna encircles the detacher and reads information from the second portion of the combination EAS/RFID tag at a position relative to the detacher when the second portion of the tag is disposed at any angle relative to the detacher and only when the detacher is positioned to disengage the clutch release. As long as the portion of the EAS/RFID tag containing the clutch end mechanism is located over the detaching magnet, the RFID label is in a valid detection zone regardless of its orientation relative to the antenna.

20 Claims, 14 Drawing Sheets

ANTENNA FOR A COMBINATION EAS/RFID TAG WITH A DETACHER

CROSS-REFERENCE TO RELATED APPLICATIONS

This application claims the benefit of priority of U.S. Provisional Patent Application Ser. No. 60/624,402 by Shafer et al, entitled "NEAR FIELD PROBE FOR READING RFID TAGS AND LABELS AT CLOSE RANGE", filed on Nov. 2, 2004 and U.S. Provisional Patent Application Ser. No. 60/659,289 by Copeland et al, entitled "LINEAR MONOPOLE MICROSTRIP RFID NEAR FIELD ANTENNA", filed on Mar. 7, 2005, the entire contents of both of which being incorporated by reference herein.

BACKGROUND

1. Technical Field

This disclosure relates to the field of electronic article surveillance (EAS) and radiofrequency identification (RFID) tags and more particularly, to a RFID read antenna for a combination EAS and RFID tag.

2. Background of Related Art

The use of a combination EAS/RFID security tag offers an added benefit of inventory control capability along with the traditional anti-theft deterrence from the EAS technology. The combination EAS/RFID security tag may be attached to clothing items using a pin attachment mechanism. This attachment mechanism may be removed by a detacher that may employ a magnetic means to release the pin.

It is advantageous to read the RFID information when the pin is being removed. Furthermore, it may be of interest to enable the removal of the pin by first reading and verifying the RFID information.

To detach the pin of the combination EAS/RFID security tag, the user places the end of the tag in a defined center region of the detacher. It should be noted that the security tag may rotate about the detacher magnet region at any arbitrary angle. Therefore, the orientation of the RFID element with respect to the detacher center may be quite arbitrary. If the RFID element must be read in this position, then either the detachment orientation needs to be fixed in order to allow a fixed position RFID near-field antenna to read exactly at this fixed position or a new omni-directional RFID near-field antenna is needed.

Therefore, there exists a need for the development of an RFID read antenna which enables a combination EAS/RFID hard tag to be detached and read consistently and accurately at all times independently of the angle of the EAS/RFID tag relative to the RFID antenna.

SUMMARY

The present disclosure relates to a security device for detaching a combination electronic article surveillance (EAS) and radio frequency identification (RFID) tag (EAS/RFID tag). The security device includes a detacher configured to selectively disengage a clutch release disposed in a first portion of the combination EAS/RFID tag. The security device also includes a near field antenna substantially circular meander-like antenna configured to electronically read information stored in a second portion of the combination EAS/RFID tag. The near field antenna is configured to substantially encircle the detacher and is configured to read information from the second portion of the combination BAS/RFID tag at a position relative to the detacher when the second portion of the tag is disposed substantially tangentially relative to, and at any angle relative to, the detacher.

The near field antenna may be configured to read information only when the detacher is positioned to disengage the clutch release in the first portion of the combination EAS/RFID tag. The detacher may magnetically disengage the clutch release.

In one embodiment, the antenna is a substantially concentrically circular meander-like microstrip antenna which includes first and second antenna portions each extending as continuous conductors substantially 180 degrees in a meander-like configuration around and between an inner concentric circle reference and an outer concentric circle reference to a common joining position, the inner and outer concentric circle references having a common center point.

The first antenna portion may extend from a first position outside of the perimeter of the outer concentric circle at zero degrees to a first position on the inner concentric circle and may extend in the meander-like configuration around and between the inner and outer concentric circle references to the common joining position. The second antenna portion may extend from a second position outside of the perimeter of the outer concentric circle at zero degrees to a second position on the inner concentric circle and may extend in the meander-like configuration around and between the inner and outer concentric circle references to the common joining position.

In one embodiment, the security device further includes a substrate, the substrate having a first surface and a second surface; a feed port mounted on the substrate; a terminating resistor mounted on the substrate; and a ground plane. The concentrically circular meander-like antenna microstrip is mounted on the first surface of the substrate and the second surface of the substrate is mounted on the ground plane, and the feed port is coupled to the first and second portions of the antenna and the terminating resistor is coupled to the first and second portions of the antenna at the common joining position and to the ground plane. The feed port may be excited by one of a monopole and a dipole feed excitation signal.

The second portion of the combination EAS/RFID tag may include an RFID element and the RFID element resides substantially above the perimeter of the circular microstrip antenna.

The present disclosure relates also to an alternate embodiment of a security device for detaching combination electronic article surveillance (EAS) and radio frequency identification (RFID) tags (EAS/RFID tags). The security device includes a detacher having an axis defined therethrough. The detacher is configured to selectively disengage a clutch release disposed in a first portion of the combination EAS/RFID tag. The security device also includes a substantially concentrically circular meander-like circular-shaped microstrip near field antenna configured to electronically read information stored in a second portion of the combination EAS/RFID tag. The near field antenna is configured to substantially encircle the detacher and is configured to read information from the second portion of the combination EAS/RFID tag when the combination EAS/RFID tag is positioned substantially tangentially relative to, and at any angle relative to said axis.

The near field antenna is configured to only read information when detacher is positioned to disengage the clutch release in the first portion of the combination EAS/RFID tag.

The security device may further include a substrate. The substrate has a first surface and a second surface; a feed port mounted on the substrate; a terminating resistor mounted on the substrate; and a ground plane. The concentrically circular meander-like antenna microstrip is mounted on the first surface of the substrate and the second surface of the substrate is mounted on the ground plane, and the feed port is coupled to a first portion of the antenna and the terminating resistor is coupled to a second portion of the antenna and to the ground plane.

The present disclosure relates also to an antenna for use with a combination electronic article surveillance (EAS) and radiofrequency identification (RFID) tag. The antenna includes a substrate; and a substantially concentrically circular meander-like microstrip mounted on the substrate which includes first and second antenna portions each extending as continuous conductors substantially 180 degrees in a meander-like configuration around and between an inner concentric circle reference and an outer concentric circle reference to a common joining position, the inner and outer concentric circle references having a common center point.

The first antenna portion extends from a first position outside of the perimeter of the outer concentric circle at zero degrees to a first position on the inner concentric circle and extends in the meander-like configuration around and between the inner and outer concentric circle references to the common joining position; and the second antenna portion extends from the first position outside of the perimeter of the outer concentric circle at zero degrees to a second position on the inner concentric circle and extends in the meander-like configuration around and between the inner and outer concentric circle references to the common joining position.

The common joining position may be disposed on the outer concentric circle.

The antenna may further include a detacher magnet having a substantially circular perimeter, the substantially concentrically circular meander-like microstrip being mounted on the substrate around the perimeter of the detacher magnet. The antenna may further include a feed port mounted on the substrate; and a terminating resistor mounted on the substrate, wherein the feed port is coupled to a first portion of the antenna and the terminating resistor is coupled to a second portion of the antenna.

The substrate may include first and second surfaces, wherein the antenna further includes a ground plane, and the substantially circular meander-like microstrip is mounted on the first surface of the substrate and the second surface of the substrate is mounted on the ground plane, and the feed port is coupled to a first portion of the antenna and the terminating resistor is coupled to a second portion of the antenna and to the ground plane. The feed port may be excited by one of a monopole and dipole feed excitation signal.

The microstrip antenna may be configured to define a mean reference circle between the inner reference circle and the outer reference circle. The mean reference circle has a diameter $D_M$ which is the mean of the diameters of the inner and outer reference circles, respectively, and the mean diameter $D_M$ ranges from about $c/\{2\pi f(\in_r)^{1/2}\}$ to about $c/\{\pi f(\in_r)^{1/2}\}$, where c is the speed of light ($3\times10^8$ meters/second), f is the operating frequency (cycles/second), and $\in_r$ is the relative permittivity of the substrate.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The present disclosure will be understood more fully frown the detailed description given below and from the accompanying drawings of particular embodiments of the disclosure which, however, should not be taken to limit the disclosure to a specific embodiment but are for explanatory purposes.

Numerous specific details may be set forth herein to provide a thorough understanding of a number of possible embodiments of a near field RFID read antenna for a combination EAS/RFID tag according to the present disclosure. It will be understood by those skilled in the art, however, that various embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of any embodiments disclosed herein.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments disclosed herein are not necessarily limited in this context.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
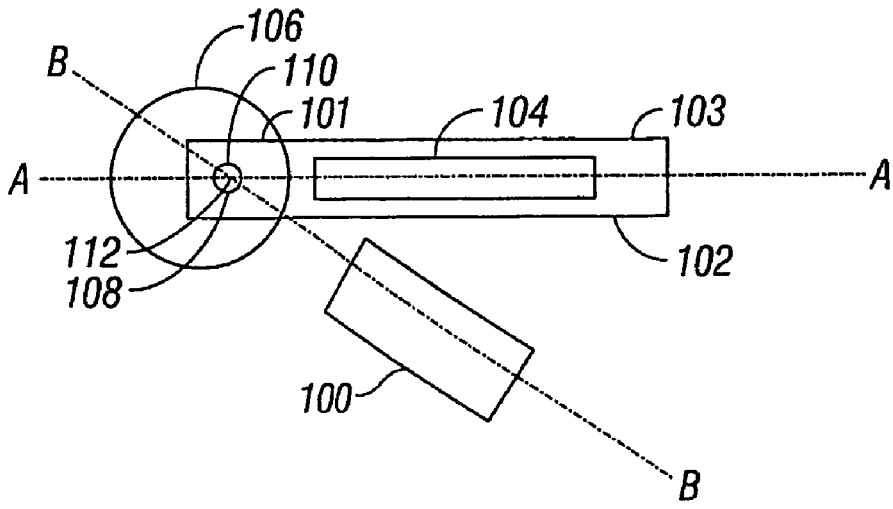
FIG. 1 (Prior Art)
FIG. 1 illustrates a combination EAS/RFID hard tag with a detacher magnet and a prior art RFID read antenna with the hard tag in a first orientation with respect to the RFID read antenna.

FIG. 1 illustrates a prior art RFID read antenna 100 positioned with respect to a combination EAS/RFID hard tag 102. The EAS/RFID hard tag 102 includes a clutch release mechanism 108 disposed in a first or tag head portion 101 of the combination RFID/EAS tag 102. The EAS/RFID hard tag 102 includes a RFID read element 104 disposed in a second or RFID element portion 103 of the EAS/RFID hard tag 102. The clutch release mechanism 108 typically provides an EAS deactivation function to release a pin 112 of a detacher magnet 106 disposed on an article (not shown) typically for surveillance purposes. The pin 112 attaches the magnet 106 to the article and to the clutch release mechanism 108. Therefore, the clutch release mechanism 108 functions as a detacher. In this prior art configuration, the RFID read antenna 100 is a near field general dipole microstrip antenna which extends along an axis B-B linearly to and through magnet 106. This particular combination EAS/RFID tag 102 also has a substantially linear configuration and includes a longitudinal axis A-A which extends therealong and to magnet 106. Axes A-A and B-B intersect at a common point, i.e., at the central point 110 of magnet 106, such that the axes A-A and B-B form an angle θ with respect to each other. Typically, the central point 110 is the position at which the clutch release mechanism 108 releases the pin and magnet 106. As illustrated in FIG. 1, the angle θ is of such a magnitude that the RFD element portion 104 of the EAS/RFID tag 102 is out of range of the RFD read antenna 100 and so the RFID information stored in the RFID element portion 104 cannot be read. Nevertheless, the clutch release mechanism 108 can be activated by the detacher magnet 106 without therefore first reading the RFD element portion 104 information.

Figure 2:
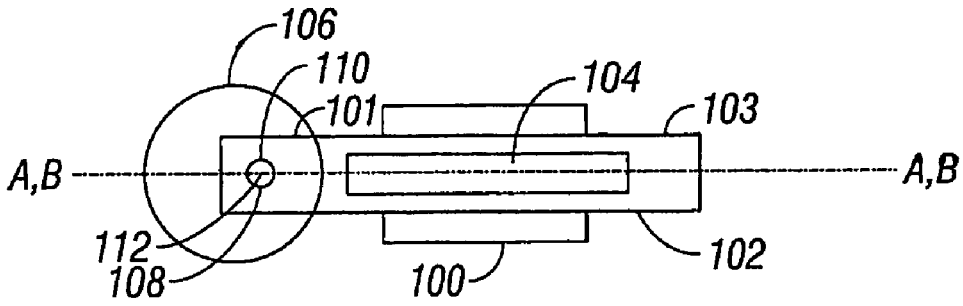
FIG. 2 (Prior Art)
FIG. 2 illustrates the combination EAS/RFID hard tag with a detacher magnet and RFID read antenna of FIG. 1 with the hard tag in a second orientation with respect to the RFID read antenna.

FIG. 2 illustrates the combination EAS/RFID hard tag 102 with the detacher magnet 106 and RFID read antenna 100 of FIG. 1 with the hard tag 102 in a second orientation with respect to the RFID read antenna 100. More particularly, since the axis A-A of the combination EAS/RFID hard tag 102 is oriented in a parallel position with respect to the axis B-B of the RFID read antenna 100, the angle θ is now 0° and so the RFID elements of the combination EAS/RFID hard tag 102 are positioned directly over the RFID read antenna 100. In this position, the RFID read element 104 disposed in the RFID read element portion 103 is within the near field of the RFID read antenna 100, and the RFID information can be read while at the same time, the clutch release mechanism 108 can be activated by the detacher magnet 106 to release the pin 112 without therefore first reading the information of the RFID read element 104.

As can be appreciated by the prior art teachings, the magnetic release clutch mechanism 108 of the EAS portion 101 is enabled when the clutch release mechanism 108 is directly over the magnet 106 irrespective of the position of the RFID element 104. Mechanism 108 can be activated to release the pin with the help of the detacher magnet 106. Thus, there is no assurance that the RFID information is gathered at the point of sale. In other words, the RFID read element 104 contained in the hard tag 102 is read only when directly over, or substantially directly over, the RFID read antenna 100 as shown in FIG. 2. The obvious disadvantage of this approach is that the user, e.g., typically a person responsible for preventing loss of the article, must ensure that the RFID element 104 in the hard tag 102 is directly over the RFID read antenna 100 at all times to ensure that the RFID information is gathered.

Figure 3:
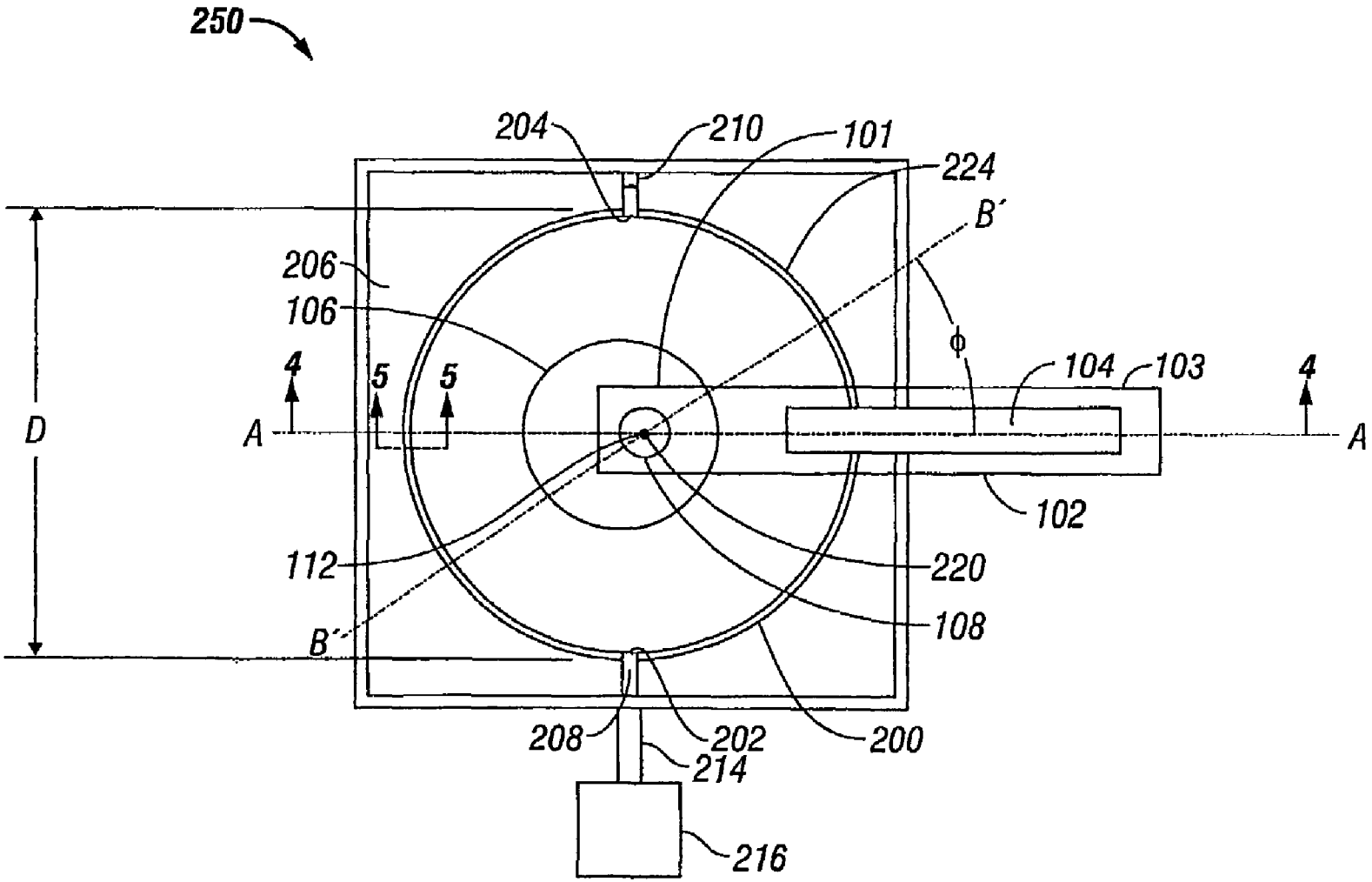
FIG. 3 illustrates a combination EAS/RFID hard tag with a detacher magnet and a circular RFID read antenna according to the present disclosure.

Turning now to the details of the present disclosure, FIG. 3 shows a security device 250 which includes the combination EAS/RFD hard tag 102 with the detacher magnet 106 and an RFD read antenna 200 according to the present disclosure. The antenna 200 includes a substantially circular microstrip configuration of generally two semicircular arcuate portions 222 and 224. The antenna 200 is mounted typically on a substrate 206. A feed port 208, which is also mounted on the substrate 206, supplies a feed signal via a cable 214, which may be a coaxial cable, to the antenna 200 and is coupled to the antenna 200 at a first position 202. A terminating resistor 210, which is also mounted on the substrate 206, is coupled to the antenna 200 at a second position 204. In one embodiment, the first position 202 and the second position 204 are substantially diametrically opposed to one another. In one embodiment, the antenna 200 substantially encircles the detacher magnet 106. The detacher magnet 106 has a center point 220. The antenna 200 and the detacher magnet 106 may be concentric. The embodiments are not limited in this context. The combination EAS/RFID tag 102 has a configuration such that a first axis A'-A' is defined therethrough extending from the first or tag head portion 101 through to the RFID read element portion 103. As illustrated in FIG. 3, the combination EAS/RFD hard tag 102 is positioned so that the axis A'-A' intersects center 220 of magnet 106 for the sake of illustration purposes.

A second axis B'-B' is defined through the detacher magnet 106 for explanatory purposes such that axes A'-A' and B'-B' intersect over the center point 220 and define a variable angle ϕ therebetween. Either of the axes A'-A' and B'-B' may be rotated with respect to the other axis such that the angle ϕ may be varied from 0 degrees to 360 degrees.

Figure 4:
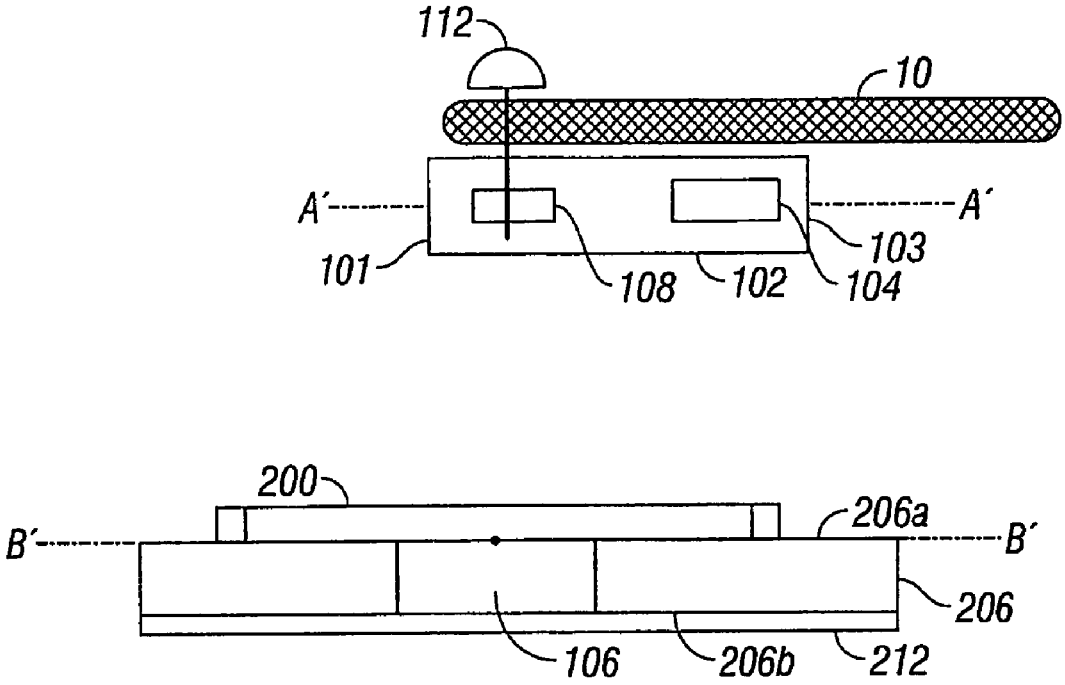
FIG. 4 is a cross-sectional elevation view of the combination EAS/RFID hard tag with a detacher magnet and an RFID read antenna taken along line 4-4 of FIG. 3.
Figure 5:
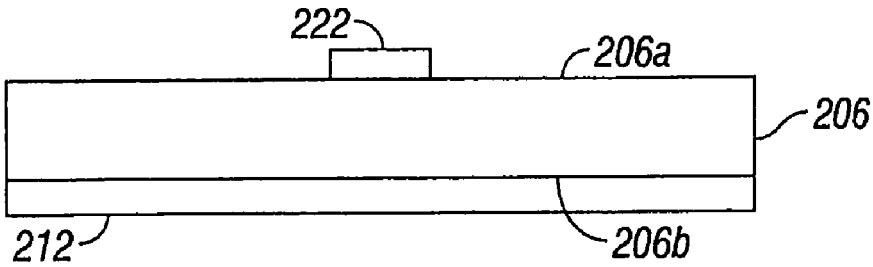
FIG. 5 is a cross-sectional elevation view of the combination EAS/RFID hard tag with a detacher magnet and an RFID read antenna taken along line 5-5 of FIG. 3.

As illustrated in FIGS. 3, 4 and 5, the substrate 206 includes typically an upper or first surface **206*a* and typically a lower or second surface 206*b*. The antenna 200 is mounted or disposed on the first surface 206*a*. The second surface 206*b* of the substrate 206 is mounted or disposed on a ground plane 212. The cable 214 includes a first terminal which is coupled or connected to the antenna 200 to feed power to the two antenna semicircular portions 222 and 224, and a second terminal which is coupled or connected to the ground plane 212. In addition to being coupled to the antenna 200, the terminating resistor 210 extends to and couples to the ground plane 212. Therefore, as illustrated in FIGS. 4 and 5, the antenna 200 is configured to operate as a monopole antenna, so that the feed port 208** is excited by a monopole feed excitation signal.

As discussed previously, the pin 112 of the combination EAS/RFID tag 102 attaches to an article, which is illustrated as article 10 in FIG. 4. The EAS/RFD tag 102 includes the clutch release mechanism 108 and the RFID read element 104 which are disposed at the first or tag head portion 101 and the second or RFID element portion 103 of the EAS/RFID tag 102, respectively. The clutch release mechanism 108 releases the tag 102 from the article when in proximity to the detacher magnet 106. More particularly, the pin 112 is released from the article 10 when the tag head 101 is placed in the detacher 106, allowing the article 10 to be released from the EAS/RFID security tag 102.

In one embodiment, according to the present disclosure, the detacher magnet 106 has a substantially circular perimeter and is mounted in and substantially at the center of the substrate 206. The antenna 200 is configured such that when the EAS/RFID tag 200 is disposed at any angle $\phi$ with respect to the antenna 200, and the clutch release mechanism 108 is placed in proximity to the detacher magnet 106, the RFID antenna element 104 is readable by the antenna 200. More particularly, the read range of antenna 200 is independent of angle $\phi$ as the pin 112 and clutch release mechanism 108 are centered substantially over the center point 220 of the detacher magnet 106 and the combination (EAS/RFID security) tag 102 is rotated about the center point 220. The clutch release mechanism 108 need not be precisely over the center point 220 to enable actuation of the clutch release mechanism 108.

The clutch release mechanism 108 may not be only magnetic but may be any type of EAS detacher, including but not limited to an electrically operated solenoid or pneumatically or hydraulically operated release mechanisms.

It is particularly noteworthy that the antenna 200 has a consistent read range of zero degrees to about 360 degrees.

It is envisioned that the circular microstrip antenna 200 may be considered as part of a combined EAS and REID system 250 which includes the aforedescribed combination EAS/RFID tag 102, antenna 200 and detacher magnet 106. The EAS/RFID tag 102 is configured to be attached to the article 10.

As disclosed previously, but herein with respect to the system 250, the antenna 200 is configured such that when the EAS/RFID tag 102 is disposed at any angle $\phi$ with respect to the antenna 200, and the clutch release mechanism 108 is placed in proper proximity to the detacher magnet 106 enabling detachment, the RFID antenna element 104 is readable by the RFID read antenna 200

As part of the system 250, the features and limitations of the antenna 200 are essentially identical to those described previously.

Those skilled in the art will recognize that other configurations of microstrip antenna 200 are possible including but not limited to shapes which are elliptical or oval, triangular, square, rectangular, parabolic or hyperbolic, curvilinear, polygonal, or irregular.

It has been determined that the electric field that couples to the RFID element 104 in the combination EAS/RFD hard tag 102 is radially oriented outside and above the circular microstrip 200, making the combination EAS/RFID hard tag 102 easily detectable even if the hard tag 102 is placed at any angle $\phi$ with respect to the magnet center or origin 220. It is envisioned that the read range may be optimized at a point when the clutch mechanism 108 is positioned over, or is relatively proximate to, the detacher magnet 106.

Turning now to a more detailed discussion of the microstrip antenna 200, antenna 200 is similar to two $\lambda/2$ microstrips configured as circular arcs so that the signal wavelength $\lambda$ corresponds to $\lambda/2$. Therefore, as illustrated in FIG. 3, the circular diameter "D" of the near field antenna 200 should correspond to that between a half-wavelength to a full-wavelength dipole. Since the circular microstrip antenna 200 is deposited on the dielectric substrate 206, the radius a should be in the range of $a=c/\{2\pi f(\in_r)^{1/2}\}$ for the minimal value associated with the half-wavelength case and twice that for the full-wavelength case. Here c is the speed of light ($3\times10^8$ meters/second), f is the operating frequency (cycles/second), and $\in_r$ is the relative permittivity of the dielectric substrate material.

Figure 6:
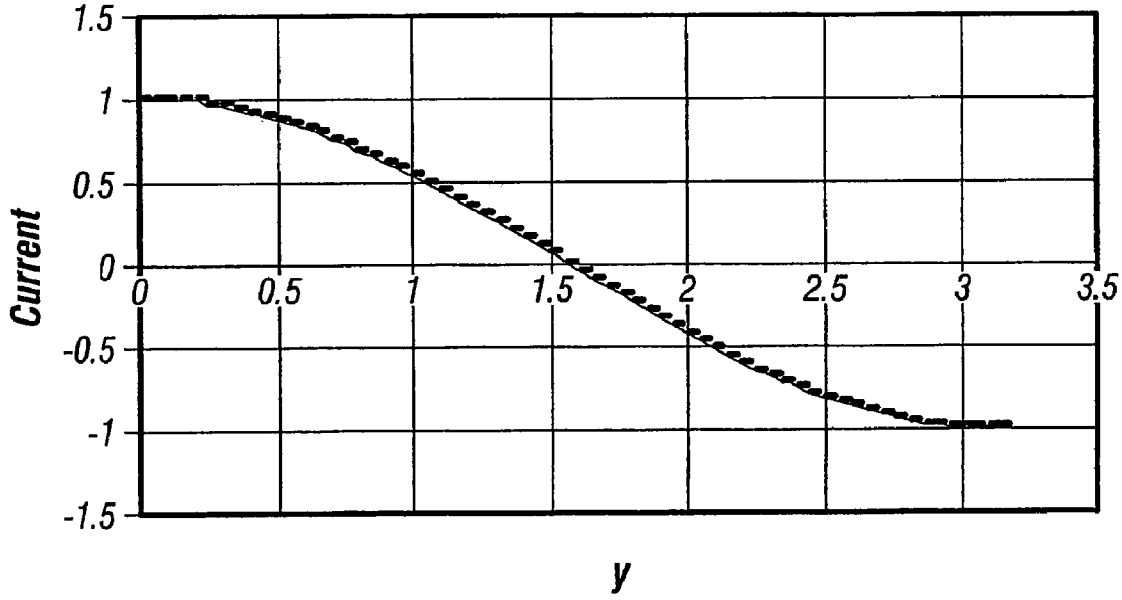
FIG. 6 is a graphical representation of the current along the RFID read antenna of FIGS. 3, 4 and 5.
Figure 7:
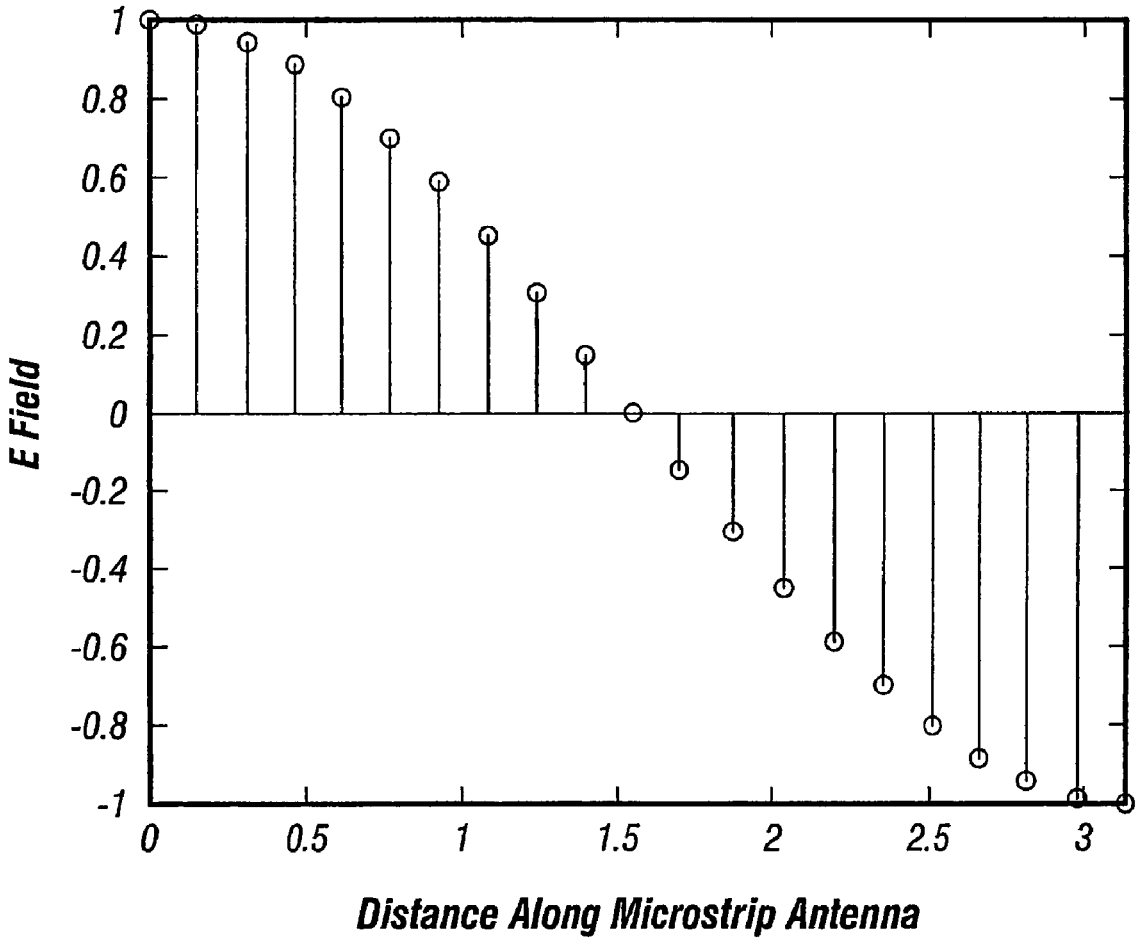
FIG. 7 is a graphical representation of a half-wave electric field (E-field) distribution above the RFID read antenna of FIG. 3.
Figure 8:
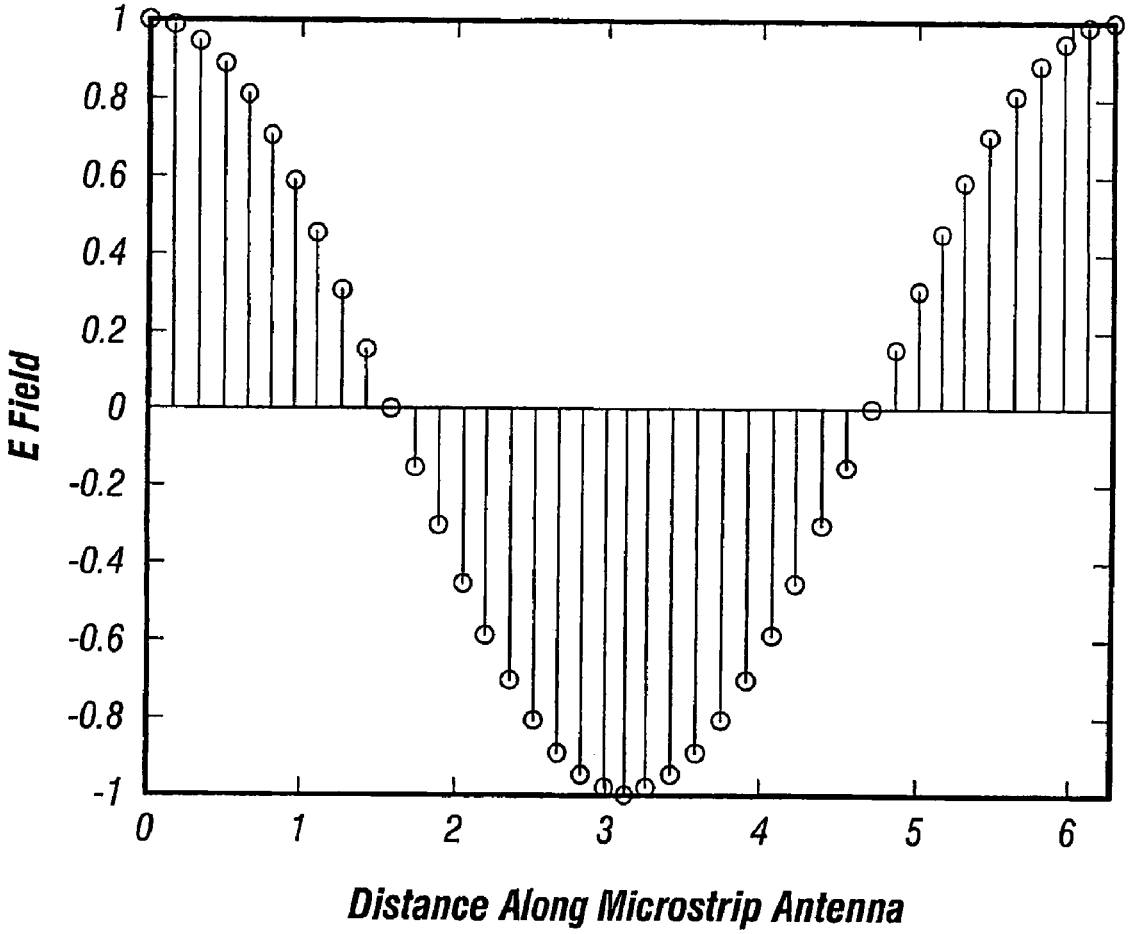
FIG. 8 is a graphical representation of a full-wave E-field distribution above the RFID read antenna of FIG. 3 at zero degrees phase.

Referring to FIGS. 6, 7 and 8, the effective length of each circular arc 222 and 224 may be in the range of a half-wavelength up to a full wavelength. As illustrated specifically in FIG. 6, in the half-wavelength configuration, the antenna current I is maximum and positive ($+I_0$) at the feed or input end 208, decreases to zero at the mid-point and is minimum and negative ($-I_0$) at the end position of the terminating resistor 210. Therefore, in the half-wavelength configuration, the antenna current goes through a phase change of 180 degrees from the input 208 to the end position of the terminating resistor 210. As illustrated in FIG. 7, the E-field at the feed point 208 is at a maximum. At the midpoint along the microstrip antenna portions 112 along the length L, the E field decreases to zero. At the termination end 118, the E field decreases to a negative peak or maximum.

As illustrated specifically in FIG. 8, for the full-wavelength configuration, the antenna current is maximum and positive at the input end 208, decays to zero a quarter of the way, then increases in a negative direction to a minimum and negative value half way, decays through zero at three quarters of the way and then increases in a positive direction back to a positive maximum at the end position of the terminating resistor 210.

The signal for the antenna 200 to read is substantially enhanced when the E-field coupling to the RFID element 104 is maximized. Such conditions occur when the RFID element 104 resides substantially outside of the perimeter of the semicircular arcuate portions 222 and 224 which form the circular antenna 200, as illustrated in FIGS. 3 and 4. In addition, the signal is enhanced when the combination EAS/RFID hard tag 102 is oriented substantially radially with respect to the center 220 of the detacher magnet 106 such that the linear axis B'-B' of the EAS/RFID hard tag 102 substantially overlaps the center 220.

Figure 9:
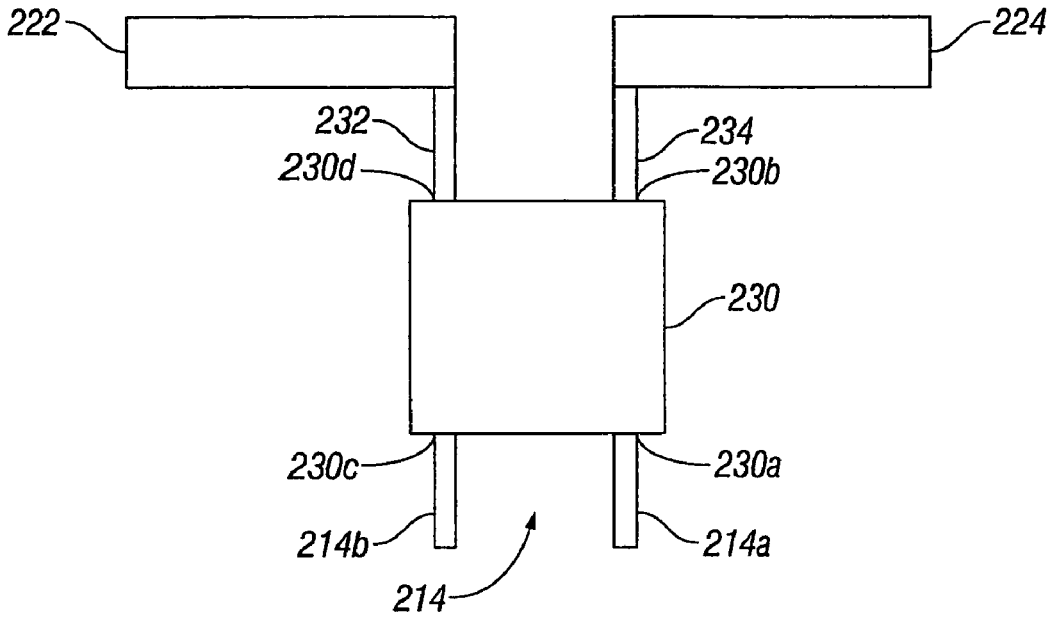
FIG. 9 illustrates a dipole feed for the RFID read antenna of FIGS. 3, 4 and 5.

FIG. 9 illustrates an alternate embodiment of the circular microstrip antenna 200. More particularly, the circular microstrip antenna 200 is configured in a dipole configuration. A first terminal 214*a* of cable 214 is connected to a voltage transformer 230 at a transformer input signal connection 230*a*. The input signal from the signal connection 230*a* is output from the transformer 230 at transformer output signal connection 230*b* where it is coupled via cable or connector 234 to semicircular arcuate portion 224.

A second terminal 214*b* of cable 214 is connected to the transformer 230 via an input signal ground connection 230*c*. The input signal ground is output from the semicircular arcuate portion 222 to transformer 230 via a connection 230*d*. Therefore, in this configuration, the semicircular portions 222 and 224 operate as a dipole antenna, so that the feed port 208 is excited by a dipole feed excitation signal.

Figure 10:
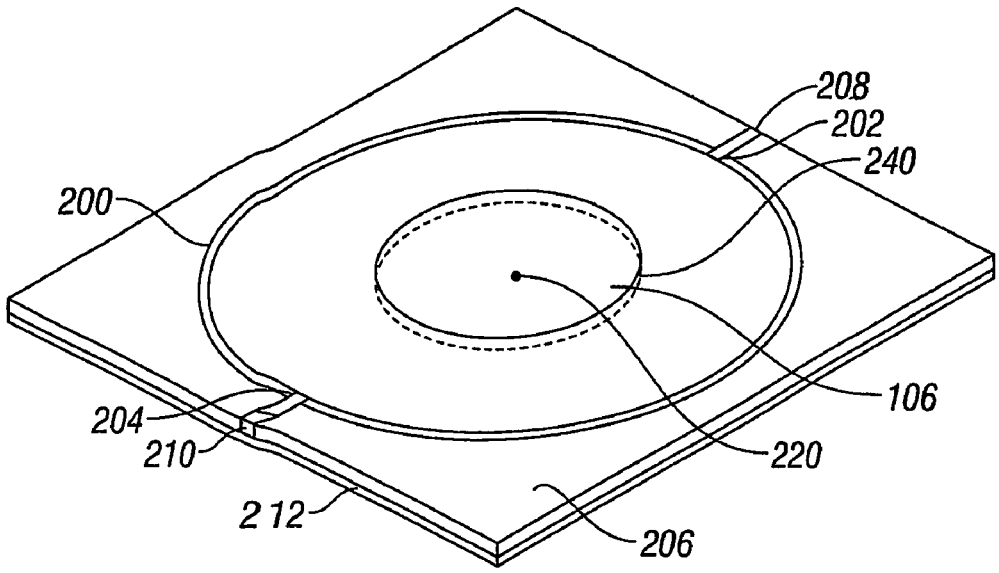
FIG. 10 is a top perspective view of one embodiment of the REID read antenna and detacher magnet of FIGS. 3, 4 and 5.

FIG. 10 is a top perspective view of one embodiment of the security device 250 wherein the microstrip antenna 200 is disposed on substrate 206. The detacher magnet 106 is disposed through an aperture 240 which is substantially centered around the center 220 of the detacher magnet 106. The aperture 240 penetrates the substrate 206 and the ground plane 212. The substantially circular microstrip 200 is mounted on the substrate 206 around the perimeter of the detacher magnet 106. The terminating resistor 210 is coupled to the microstrip antenna 200 and to the ground plane 212.

Figure 11:
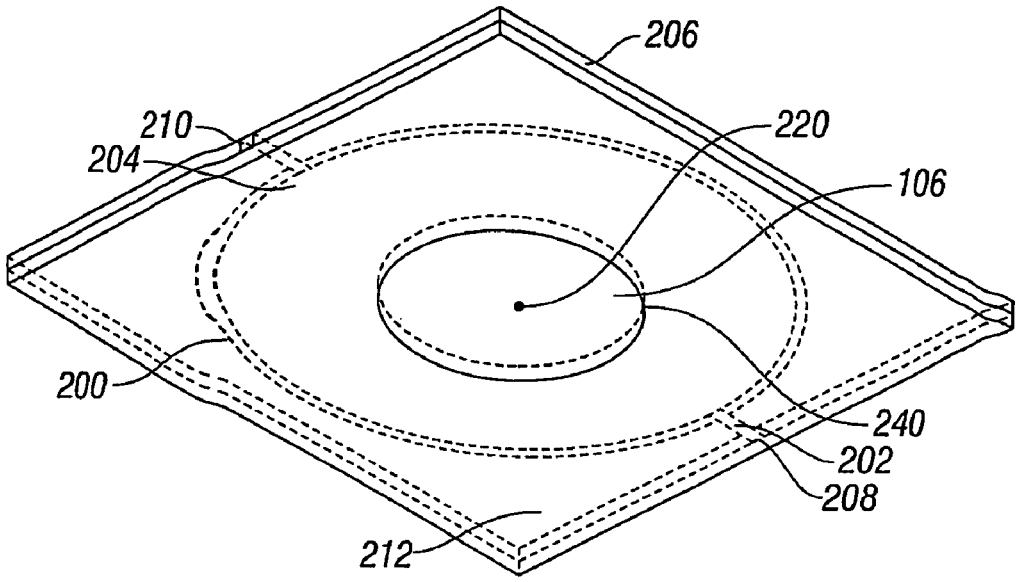
FIG. 11 is a bottom perspective view of the RFID read antenna and detacher magnet illustrated in FIG. 10.

FIG. 11 is a bottom perspective view of the security device 250 as illustrated in FIG. 10. More particularly, the detacher magnet 106 penetrates the ground plane 212 and the substrate 206 via the aperture 240.

Figure 12:
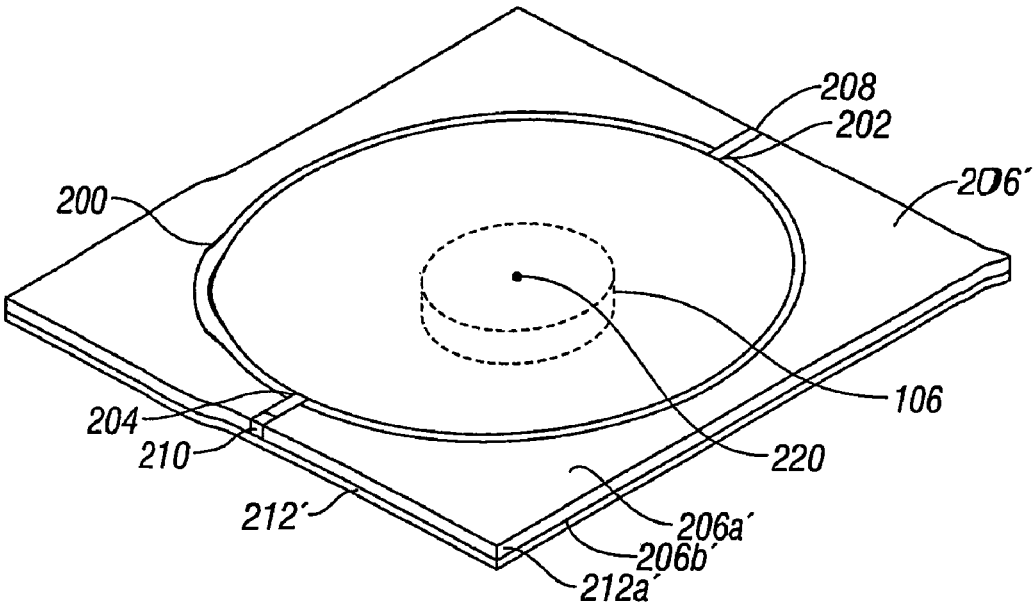
FIG. 12 is a top perspective view of an alternate embodiment of the RFID read antenna and detacher magnet of FIGS. 3, 4 and 5.
Figure 13:
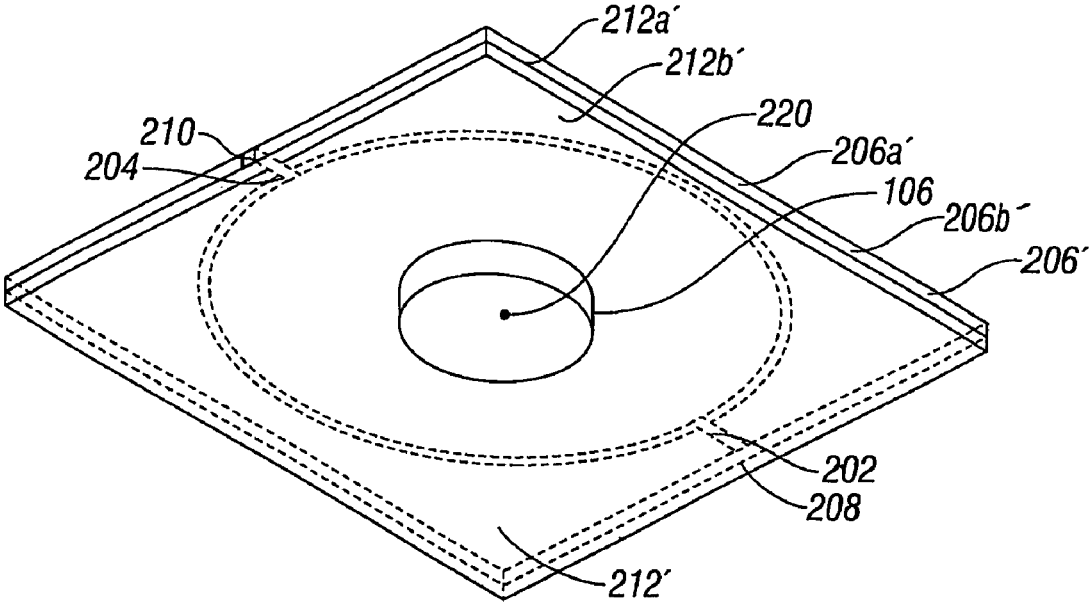
FIG. 13 is a bottom perspective view of the alternate embodiment of the RFID read antenna and detacher magnet illustrated in FIG. 12.
Figure 14:
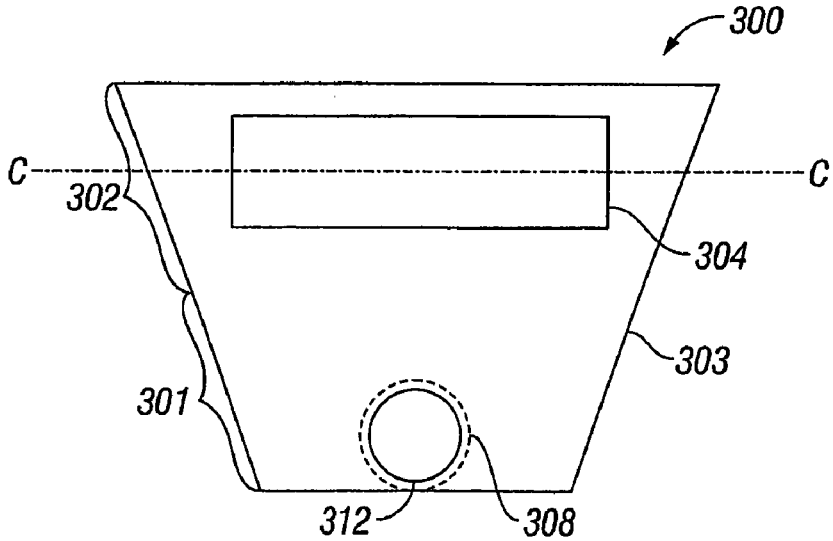
FIG. 14 is a plan view of one embodiment of a combination EAS/RFID hare tag according to the present disclosure.

FIG. 12 is a top perspective view of an alternate embodiment of the substrate 206 and ground plane 212. FIG. 13 is a bottom perspective view of the alternate embodiment of the substrate 206 and ground plane 212 illustrated in FIG. 13. More particularly, the substantially circular microstrip antenna 200 is disposed on a solid substrate 206' and a solid ground plane 212' which exclude the aperture 240. The substrate 206' includes first and second surfaces 206*a*' and 206*b*'. The ground plane 212' includes first and second surfaces 212*a*' and 212*b*'. The substantially circular microstrip 200 is mounted on the first surface 206*a*' of the substrate. The detacher magnet 106, which has a substantially circular perimeter, is disposed in proximity to the second surface 206*b*' of the substrate 206, and to the second surface 212*b*' of the ground plane 212', such that the substantially circular microstrip 200 is disposed outside the perimeter of the detacher magnet 106. Since the detacher magnet 106 is not confined by the aperture 240, the detacher magnet 106 is unrestrained and movable with respect to the microstrip 200. The operation and performance of the detacher magnet 106 with respect to the clutch release mechanism 108 are substantially equivalent whether the detacher magnet 106 is confined by the aperture 240 or whether the detacher magnet 106 is unrestrained and movable with respect to the microstrip 200.

It has been determined that the characteristics of the circular near field RFID microstrip antenna 200 are optimized as follows:

a. A read/write range which is limited to a near field distance $$d << \frac{\lambda}{2\pi}.$$

Having a read/write range d limited to a near field distance of $d << \lambda/2\pi$ allows the security device 250 to perform both EAS hard tag detachment and RFID information gathering at the point of sale. Since the read range is very small, the EAS detachment and RFD information gathering are limited to one tag at a time. In other words, at such a read range, the deactivator will not detect extraneous RFID information from other tags in close proximity.

b. A majority of energy supplied to the antenna 200 is dissipated in the terminating load resistor 210, thereby reducing the level of interference generated.

c. A near field antenna 200 that exhibits a low Q factor compared to a radiating far field antenna. The Q factor is a measure of the −3 db bandwidth divided by the center frequency or $$Q = \frac{F2 - F1}{Fc},$$

where F2 is the upper frequency −3 db point and F1 is the lower frequency −3 db point and Fc is the center frequency.

d. The low Q factor results in a wide operating bandwidth which is useful for wide band worldwide UHF applications.

e. As is known in the art, frequency hopping is a technique used to prevent readers from interfering with one another. In the United States, UHF RFID readers actually operate between 902 and 928 MHz, even though it is said that they operate at 915 MHz. The readers may jump randomly or in a programmed sequence to any frequency between 902 MHz and 928 MHz. If the band is wide enough, the chances of two readers operating at exactly the same frequency is small. The UHF bands in Europe and Japan are much smaller so this technique is not effective for preventing reader interference.

The wide operating bandwidth and low Q factor of the RFID system 250 and antenna 200 of the present disclosure allow simplified RFD reader electronics without the need for frequency hopping.

f. A near field antenna 200 that exhibits low radiation resistance and radiation efficiency, thereby reducing interference and facilitating compliance with FCC regulatory limits as compared to a radiating antenna.

g. The circular microstrip near field antenna 200 creates an E field which is radially oriented outside of the circular microstrip area.

h. As previously discussed, the circular microstrip near field antenna 200 has a diameter dimension "D" of approximately "2a", or $$D=2a=2c/\{2\pi f(\in_r)^{1/2}\}$$

for the minimal value associated with the half-wavelength case and twice that for the full-wavelength case.

i. Compliance with regulatory requirements is facilitated due to localization of emitted E-fields to the near field.

j. The circular microstrip near field antenna 200 can use either a monopole or dipole feed excitation with essentially identical RFID detection capability. More particularly, the feed port 208 can be excited by one of a monopole and dipole feed excitation signal.

k. Enhancing the coupling of the radial E field to the RFID element 104 enhances the effectiveness of the read signal. Such conditions occur when the RFID element 104 resides substantially outside of the perimeter of the circular microstrip antenna 200.

FIGS. 14 and 16-18 illustrate an alternate embodiment of a combination EAS/RFID hard tag. More particularly, combination EAS/RFID hard tag 300 includes a housing 303 with a first or front portion 301 and a second or rear portion 302. The first portion 301 includes a clutch release mechanism 308 for a pin 312 which is secured to an article 10. The pin 312 may be inserted within the clutch release mechanism 308 substantially at the center of the clutch release mechanism 308. The second portion 302 includes an RFID element 304. The RFID element 304 may have a substantially linear or rectangular configuration and may be disposed along a longitudinal axis C-C. With respect to the pin 312 and the clutch release mechanism 308, the longitudinal axis C-C of the RFID element 304 is substantially transversely or tangentially oriented.

Figure 15:
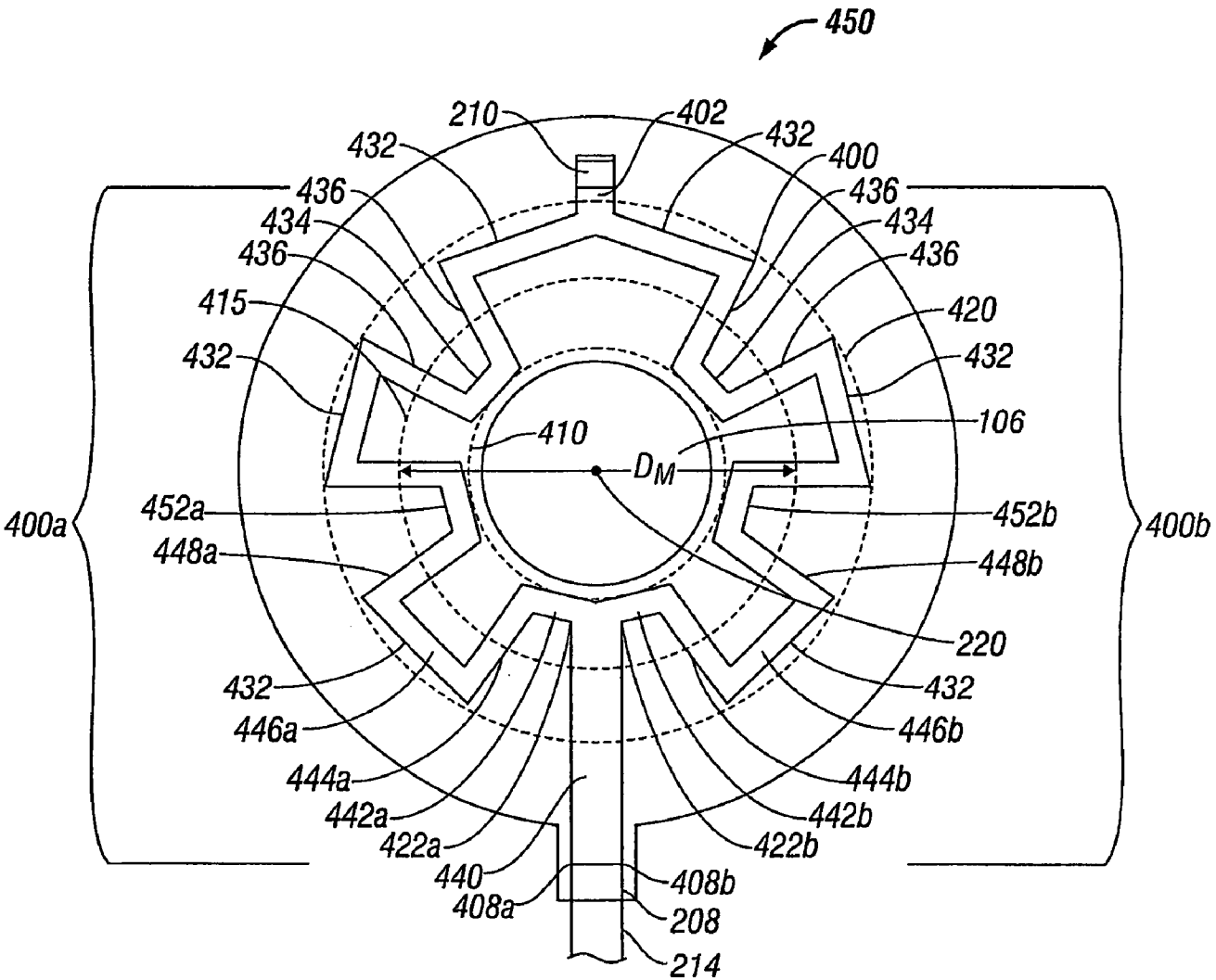
FIG. 15 is a plan view of one embodiment of a concentrically circular meander-like near field RFID read antenna according to the present disclosure.

FIG. 15 illustrates an alternate embodiment of the present disclosure of an antenna assembly 450. The antenna assembly 450 includes a substantially concentrically circular meander-like microstrip antenna 400. The meander-like microstrip antenna 400 includes first and second antenna portions 400*a* and 400*b*, respectively, each extending substantially 180 degrees in a meander-like configuration around and between an inner concentric circle reference 410 and an outer concentric circle reference 420 to a common joining position 402.

The first and second antenna portions 400*a*, 400*b* extend as continuous conductors from a first position 408*a*, 408*b* outside of the perimeter of the outer concentric circle 420 at zero degrees to a first position 422*a*, 422*b* on the inner concentric circle 410 and extend in the meander-like configuration around and between the inner and outer concentric circle references 410 and 420, respectively, to the common joining position 402.

In one embodiment, the first and second antenna portions 400*a*, 400*b* include a first common radial segment 440 extending radially towards a common centerpoint 220 from a first position 408*a*, 408*b* outside of the perimeter of the outer concentric circle reference to the first position 422*a*, 422*b* on the inner concentric circle reference 410 to a first 442*a*, 442*b* of a multiplicity of intermittent, interspaced inner chord segments 434 formed along the inner concentric circle reference 410, respectively. The first and second antenna portions 400*a*, 400*b* also include a multiplicity of intermittent, interspaced outer chord segments 432 formed along the outer concentric circle reference 420, and a multiplicity of radial segments 436.

The first of the multiplicity of radial segments 444*a*, 444*b* extends in sequence from the first interspaced inner chord segment 442*a*, 442*b* to a first of the multiplicity of intermittent, interspaced outer chord segments 446*a*, 446*b*. Similarly, the second of the multiplicity of radial segments 448*a*, 448*b* extends in sequence from the first outer chord segment 446*a*, 446*b* to the second inner chord segment 452*a*, 452*b* in sequence and terminating at the common joining position 402, at which the first and second antenna portions 400*a* and 400*b*, are joined, respectively.

In one embodiment, the common joining position 402 is disposed on the outer concentric circle 420. The embodiments are not limited in this context.

Figure 16:
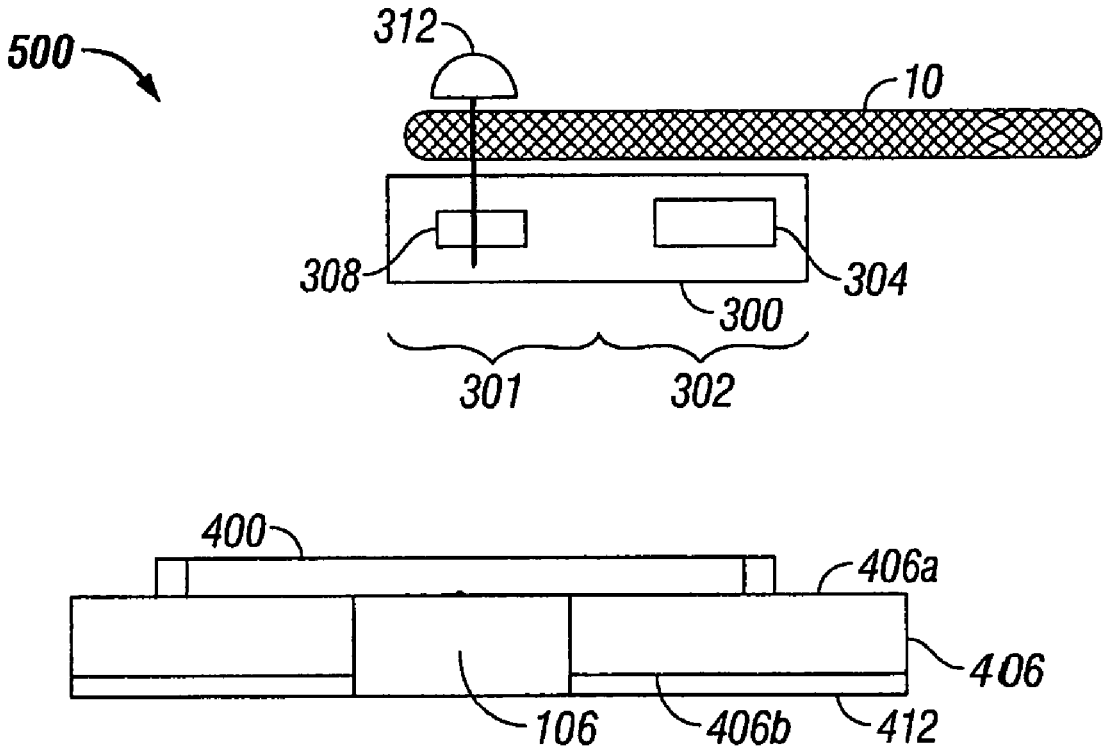
FIG. 16 is an elevation view of the combination EAS/RFD hard tag with a detacher magnet and the concentrically circular REID read antenna of FIGS. 14 and 15.

As also illustrated in FIG. 16, the antenna assembly 450 further includes a substrate 406. The substrate has a first or upper surface 406*a* and a second or lower surface 406*b*. Feed port 208 is mounted on the substrate 406 and terminating resistor 210 is also mounted on the substrate 406. The antenna assembly 450 also includes a ground plane 412. The concentrically circular meander-like antenna microstrip 400 is mounted on the first surface 406*a* of the substrate 406 and the second surface 406*b* of the substrate 406 is mounted on the ground plane 412. The feed port 208 is coupled to the first and second portions 400*a*, 400*b* of the antenna 400 and the terminating resistor 210 is coupled to the first and second portions 400*a*, 400*b* at the common joining position 402 and to the ground plane 412. As previously described with respect to antenna 200, the feed port 208 may be excited by either a monopole and a dipole feed excitation signal.

The inner and outer concentric circle references 410 and 420 may have a common center point which substantially coincides with center point 220 of detacher magnet 106.

The microstrip antenna 400 is configured to define a mean reference circle 415 between the inner reference circle 410 and the outer reference circle 420. The mean reference circle 415 has a diameter $D_M$ which is the average or mean of the diameters of the inner and outer reference circles 410 and 420 respectively.

The mean diameter $D_M$ ranges from about $c/\{2\pi f(\in_r)^{1/2}\}$ to about $c/\{\pi f(\in_r)^{1/2}\}$, where c is the speed of light ($3\times10^8$ meters/second), f is the operating frequency (cycles/second), and $\in_r$ is the relative permittivity of the substrate.

FIG. 16 also illustrates in an elevation view one embodiment of a security device for detaching the combination electronic article surveillance (EAS) and radio frequency identification (RFID) tag (EAS/RFID tag) 300. More particularly, security device 500 includes the detacher or detacher magnet 106 which is configured to selectively disengage the clutch release mechanism 308 disposed in the first portion 302 of the combination EAS/RFID tag 300. The near field antenna 400 is configured to electronically read information stored in the second portion 302 of the combination EAS/RFID tag 300. The second portion 302 of the combination EAS/RFID tag 300 includes the RFID element 304 and the RFID element 304 resides substantially above the concentrically circular meander-like microstrip antenna 400.

Figure 17:
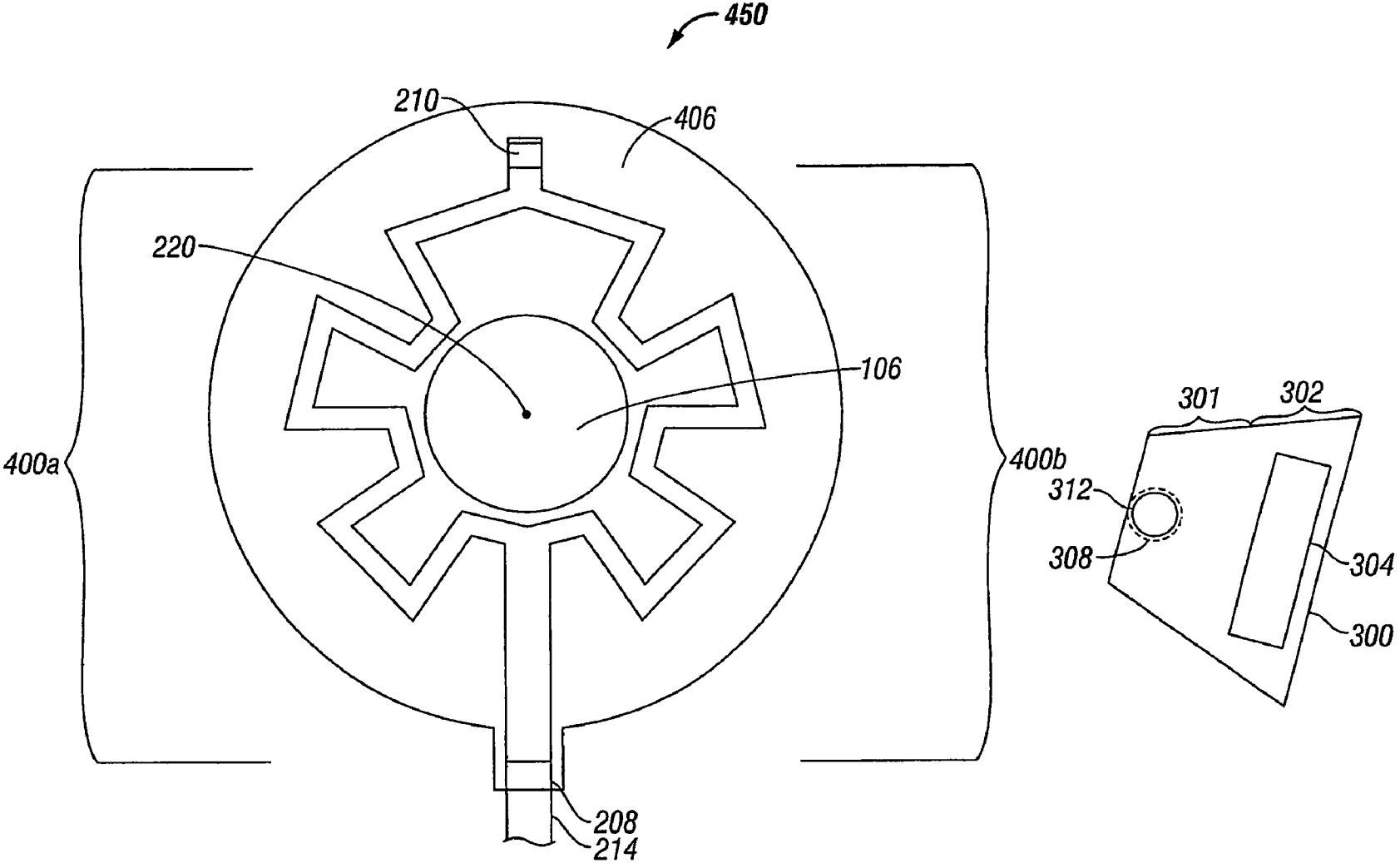
FIG. 17 is a plan view of the combination EAS/RFID hard tag out of the read range of the detacher magnet and the concentrically circular RFID read antenna.
Figure 18:
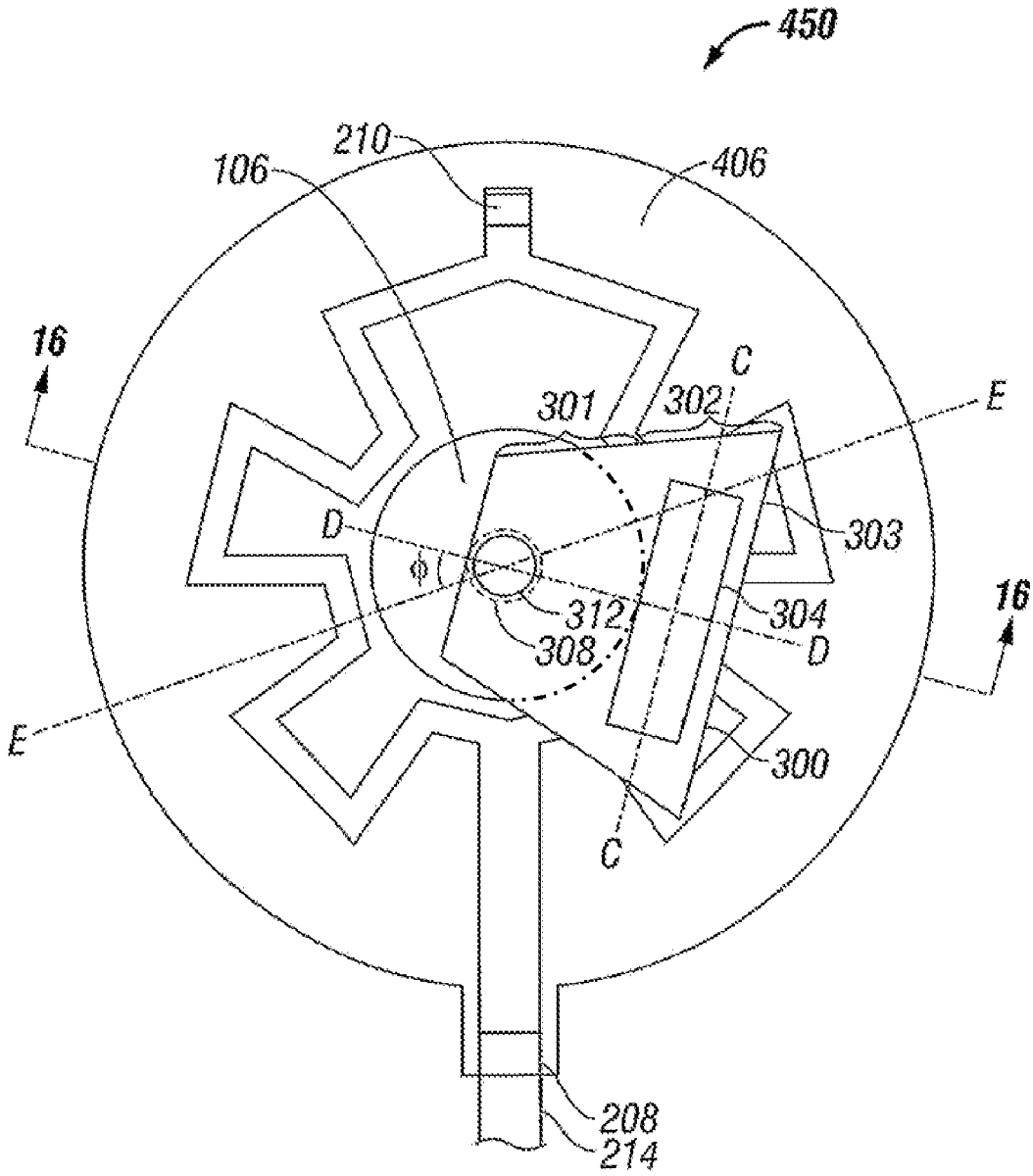
FIG. 18 is a plan view of the combination EAS/RFID hard tag in the read range of the detacher magnet and the concentrically circular RFID read antenna.

As best illustrated in FIGS. 17 and 18, the near field antenna 400 is configured to substantially encircle the detacher 106. In FIG. 17, the tag 300 is at a distance from the antenna assembly 450 where the antenna assembly cannot read the RFD element 304. In FIG. 18, the position of the tag 300 is within the read range of the antenna assembly 450. More particularly, the tag 300 is configured to read information from the second portion 302 of the combination EAS/RFID tag 300 at a position relative to the detacher 106 when the second portion 302 of the tag 300 is disposed substantially tangentially relative to, and at any circumferential angle $\phi'$ relative to the detacher 106. The angle $\phi'$ is defined by the intersection of an axis D-D passing through the housing 302 of the tag 300, and particularly through the center of pin 312 and clutch release mechanism 308, and an axis E-E passing through the center point 220 of the detacher magnet 106. The axis D-D is orthogonal to the transverse axis C-C.

The near field microstrip antenna 400 is configured to read information only when the detacher 106 is positioned to disengage the clutch release 308 in the first portion 301 of the combination EAS/RFID tag 300. The detacher 106 may magnetically disengage the clutch release 308 to release the pin 312, thereby separating the tag 300 from the article 10 (see FIG. 16).

Figure 19:
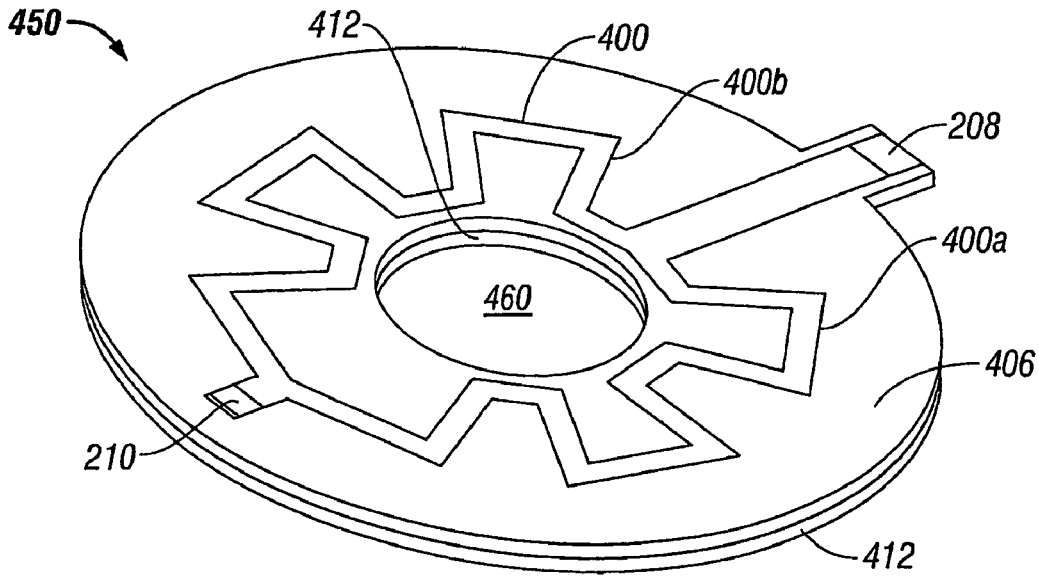
FIG. 19 is a top perspective view of the concentrically circular meander-like microstrip antenna mounted on a substrate.

FIG. 19 is a top perspective view of the antenna assembly 450 showing the substantially concentrically circular meander-like microstrip antenna 400 mounted on the first surface 406*a* of the substrate 406. The substrate 406 may have a circular configuration, although other configurations are possible. The embodiments are not limited in this context. The central region of the substrate 406 has an aperture 460 to enable the detacher 106 to be installed therethrough.

Figure 20:
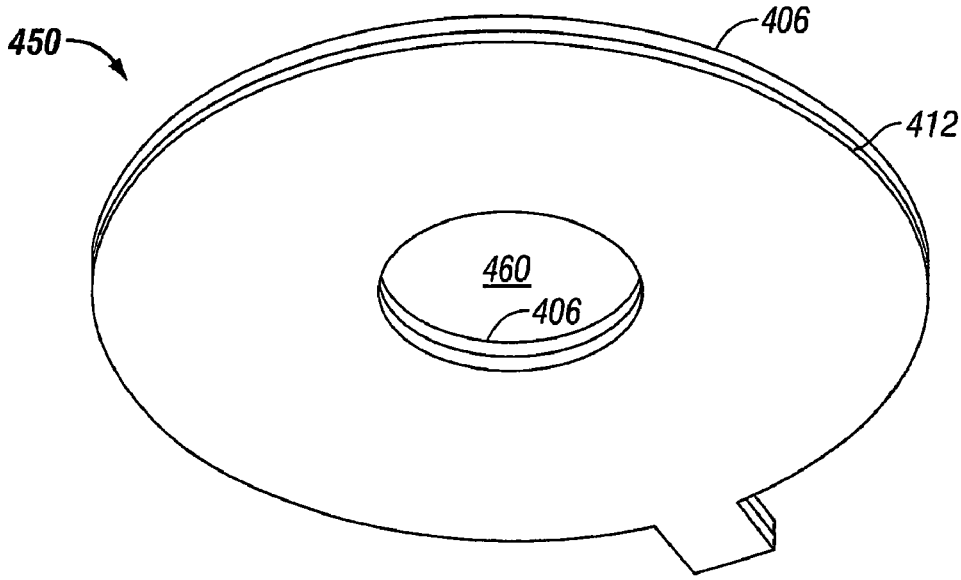
FIG. 20 is a bottom perspective view of the concentrically circular meander-like microstrip antenna showing the substrate mounted on the ground plane.

FIG. 20 is a bottom perspective view of the antenna assembly 450 showing the substrate 406 mounted on the ground plane 412. The aperture 460 also extends through the ground plane 412.

In view of the foregoing, the RFD label component, i.e., RFID read element 104 of the combined EAS/REID tag 102 is insensitive to detection over the area of the detacher magnet 106 but it is physically close to the antenna 200 so that it is well within the near field. As long as the portion of the EAS/RFID tag 102, i.e. the tag head 101, containing the clutch end mechanism 108 is located is over the detaching magnet 106, the RFID label 102 is in a valid detection zone regardless of its orientation relative to the antenna 200.

It is considered that one particular advantage of the present disclosure is that it may reduce the tag placement requirements since it will be practically impossible to release the clutch mechanism 108 without reading the RFID information on the RFID antenna element 104 of the combination tag 102.

As can be appreciated, the relative size and shape of the antenna 200 may be configured to operate with any size or shaped tags or labels. However, it is envisioned that the present disclosure will operate very well with long combination tags 102 with the RFID element antenna 104 disposed along the length of the combination tag 102 and substantially outside the perimeter of the circular antenna 200.

Since the radial electric field extends outwardly away from the center 220 of the detacher magnet 106 in a radial manner from the periphery of the antenna 200, the RFID read element 104 of the combination EAS/RFID security tag 102 should extend substantially outside of the antenna 200 when the first portion 101 of the tag 102 is placed in proximity to the center region 220 of the detacher magnet 106. Since the radial electric field which extends inwardly in a radial manner from the periphery of the antenna 200 and towards the center 220 of the detacher magnet 106 reverses direction as compared to the direction of the radial electric field which extends outwardly away from the center 220 of the detacher magnet 106 in a radial manner from the periphery of the antenna 200, it is not desirable for the RFD element 104 to be positioned in a manner so that either the RFD element 104 or the RFID element portion 103 are equally divided in interfacing relationship with the microstrip of the antenna 200, as the result would be no net differential electric field across the RFID element 104.

While certain features of the embodiments have been illustrated as described herein, many modifications, substitutions, changes and equivalents may occur to those skilled in the art. It is therefore to be understood that the appended claims are intended to cover all such modifications and changes as fall within the true spirit of the embodiments.

What is claimed is:

1. A security device for detaching a combination electronic article surveillance (EAS) and radio frequency identification (RFID) tag (EAS/RFID tag), said security device comprising:

a detacher configured to selectively disengage a clutch release disposed in a first portion of the combination EAS/RFID tag; and a near field antenna substantially circular meander-like antenna configured to electronically read information stored in a second portion of the combination EAS/RFID tag, said near field antenna configured to substantially encircle said detacher and configured to read information from said second portion of the combination EAS/RFID tag at a position relative to said detacher when said second portion of said tag is disposed substantially tangentially relative to, and at any angle relative to, said detacher.

2. A security device according to claim 1, wherein the near field antenna is configured to read information only when said detacher is positioned to disengage the clutch release in the first portion of the combination EAS/RFID tag.

3. A security device according to claim 1, wherein the detacher magnetically disengages the clutch release.

4. A security device according to claim 1, wherein the antenna is a substantially concentrically circular meander-like microstrip antenna comprising:

first and second antenna portions each extending as continuous conductors substantially 180 degrees in a meander-like configuration around and between an inner concentric circle reference and an outer concentric circle reference to a common joining position, the inner and outer concentric circle references having a common center point.

5. The security device according to claim 4, wherein the first antenna portion extends from a first position outside of the perimeter of the outer concentric circle at zero degrees to a first position on the inner concentric circle and extends in the meander-like configuration around and between the inner and outer concentric circle references to the common joining position; and the second antenna portion extends from a second position outside of the perimeter of the outer concentric circle at zero degrees to a second position on the inner concentric circle and extends in the meander-like configuration around and between the inner and outer concentric circle references to the common joining position.

6. A security device according to claim 4, wherein the security device further comprises:

a substrate, the substrate having a first surface and a second surface;

a feed port mounted on the substrate;

a terminating resistor mounted on the substrate; and a ground plane, wherein the concentrically circular meander-like antenna micro strip is mounted on the first surface of the substrate and the second surface of the substrate is mounted on the ground plane, and wherein the feed port is coupled to the first and second portions of the antenna and the terminating resistor is coupled to the first and second portions of the antenna at the common joining position and to the ground plane.

7. A security device according to claim 6, wherein the feed port is excited by one of a monopole and a dipole feed excitation signal.

8. A security device according to claim 4, wherein the second portion of the combination EAS/RFID tag includes an RFID element and the RFID element resides substantially above the perimeter of the circular-microstrip antenna.

9. A security device for detaching combination electronic article surveillance (EAS) and radio frequency identification (RFID) tags (EAS/RFID tags), said security device comprising:

a detacher having an axis defined therethrough, said detacher configured to selectively disengage a clutch release disposed in a first portion of the combination EAS/RFID tag;

a substantially concentrically circular meander-like circular-shaped microstrip near field antenna configured to electronically read information stored in a second portion of the combination EAS/RFID tag, said near field antenna configured to substantially encircle said detacher and configured to read information from said second portion of the combination EAS/RFID tag when said combination EAS/RFID tag is positioned substantially tangentially relative to, and at any angle relative to said axis.

10. A security device according to claim 9, wherein the near field antenna is configured to only read information when said detacher is positioned to disengage the clutch release in the first portion of the combination EAS/RFID tag.

11. A security device according to claim 9, wherein the security device further comprises:

a substrate, the substrate having a first surface and a second surface;

a feed port mounted on the substrate;

a terminating resistor mounted on the substrate; and a ground plane, wherein the concentrically circular meander-like antenna microstrip is mounted on the first surface of the substrate and the second surface of the substrate is mounted on the ground plane, and the feed port is coupled to a first portion of the antenna and the terminating resistor is coupled to a second portion of the antenna and to the ground plane.

12. An antenna for use with a combination electronic article surveillance (EAS) and radiofrequency identification (RFID) tag, the antenna comprising a substrate;

a substantially concentrically circular meander-like microstrip mounted on the substrate comprising:

first and second antenna portions each extending as continuous conductors substantially 180 degrees in a meander-like configuration around and between an inner concentric circle reference and an outer concentric circle reference to a common joining position, the inner and outer concentric circle references having a common center point;

the antenna configured to electronically read information stored in a RFID portion of the combination EAS and RFID tag, said antenna configured to substantially encircle a detacher and configured to read information from the RFID portion of the combination EAS and RFID tag at a position relative to the detacher when the RFID portion of the combination EAS and RFID tag is disposed substantially tangentially relative to, and at any angle relative to, the detacher.

13. An antenna according to claim 12, wherein the first antenna portion extends from a first position outside of the perimeter of the outer concentric circle at zero degrees to a first position on the inner concentric circle and extends in the meander-like configuration around and between the inner and outer concentric circle references to the common joining position; and the second antenna portion extends from a second position outside of the perimeter of the outer concentric circle at zero degrees to a second position on the inner concentric circle and extends in the meander-like configuration around and between the inner and outer concentric circle references to the common joining position.

14. An antenna according to claim 13, wherein the first antenna portion includes:

a first common radial segment extending radially towards the common centerpoint from a first position outside of the perimeter of the outer concentric circle reference to a first position on the inner concentric circle reference to a first of a multiplicity of intermittent, interspaced inner chord segments formed along the inner concentric circle reference;

a multiplicity of intermittent, interspaced outer chord segments formed along the outer concentric circle reference; and a multiplicity of radial segments, wherein the first of the multiplicity of radial segments extends in sequence from the first interspaced inner chord segment to a first of the multiplicity of intermittent, interspaced outer chord segments, the second of the multiplicity of radial segments extends in sequence from the first outer chord segment to the second inner chord segment in sequence and terminating at the common joining point; and wherein the second antenna portion includes:

the first common radial segment extending radially from the first position outside of the perimeter of the outer concentric circle reference to the first position on the inner concentric circle reference to a first of a multiplicity of intermittent, interspaced inner chord segments formed along the inner concentric circle reference;

a multiplicity of intermittent, interspaced outer chord segments formed along the outer concentric circle reference; and a multiplicity of radial segments, wherein the first of the multiplicity of radial segments extends in sequence from the first interspaced inner chord segment to a first of the multiplicity of intermittent, interspaced outer chord segments, the second of the multiplicity of radial segments extends in sequence from the first outer chord segment to the second inner chord segment in sequence and terminating at the common joining point, at which the first and second antenna portions are joined.

15. An antenna according to claim 12, wherein the common joining position is disposed on the outer concentric circle.

16. An antenna according to claim 12, the antenna further comprising:

a detacher magnet having a substantially circular perimeter, the substantially concentrically circular meander-like microstrip being mounted on the substrate around the perimeter of the detacher magnet.

17. An antenna according to claim 12, wherein the antenna further comprises:

a feed port mounted on the substrate; and a terminating resistor mounted on the substrate, wherein the feed port is coupled to a first portion of the antenna and the terminating resistor is coupled to a second portion of the antenna.

18. An antenna according to claim 12, wherein the substrate comprises first and second surfaces, wherein the antenna further comprises:

a ground plane, and wherein the substantially circular meander-like microstrip is mounted on the first surface of the substrate and the second surface of the substrate is mounted on the ground plane, and the feed port is coupled to a first portion of the antenna and the terminating resistor is coupled to a second portion of the antenna and to the ground plane.

19. An antenna according to claim 17, wherein the feed port is excited by one of a monopole and dipole feed excitation signal.

20. The antenna according to claim 12, wherein the micro strip antenna is configured to define a mean reference circle between the inner reference circle and the outer reference circle, the mean reference circle having a diameter $D_M$ which is the mean of the diameters of the inner and outer reference circles, respectively, and the mean diameter $D_M$ ranges from about $c/\{2\pi f(\in_r)^{1/2}\}$ to about $c/\{2\pi f(\in_r)^{1/2}\}$, where c is the speed of light ($3\times10^8$ meters/second), f is the operating frequency (cycles/second), and $\in_r$ is the relative permittivity of the substrate.

* * * * *